US007040105B2

(12) United States Patent
Kouno et al.

(10) Patent No.: US 7,040,105 B2
(45) Date of Patent: May 9, 2006

(54) AIR CONDITIONER AND METHOD OF CONTROLLING AIR CONDITIONER

(75) Inventors: Shigetomi Kouno, Kusatsu (JP); Yoshihiro Nishiura, Kusatsu (JP); Atsushi Matsubara, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 36 days.

(21) Appl. No.: 10/493,863

(22) PCT Filed: Aug. 8, 2003

(86) PCT No.: PCT/JP03/10183

§ 371 (c)(1),
(2), (4) Date: Apr. 28, 2004

(87) PCT Pub. No.: WO2004/016993

PCT Pub. Date: Feb. 26, 2004

(65) Prior Publication Data

US 2004/0244391 A1 Dec. 9, 2004

(30) Foreign Application Priority Data

Aug. 12, 2002 (JP) ..... 2002-234698

(51) Int. Cl.
*F25D 17/04* (2006.01)
*F24F 7/00* (2006.01)

(52) U.S. Cl. ..... 62/186; 62/178; 62/179; 236/493

(58) Field of Classification Search ..... 62/179, 62/186, 408, 177, 178, 180; 236/493
See application file for complete search history.

(56) References Cited

U.S. PATENT DOCUMENTS 5,186,387 A * 2/1993 Doi et al. ..... 236/49.3
5,385,031 A * 1/1995 Kizawa et al. ..... 62/186
6,012,297 A * 1/2000 Ichishi et al. ..... 62/179

FOREIGN PATENT DOCUMENTS

JP 2001-41538 A 2/2001
JP 2001-153430 A 6/2001

* cited by examiner

*Primary Examiner*—Marc Norman
(74) *Attorney, Agent, or Firm*—Shinjyu Global IP Counselors

(57) ABSTRACT

An air conditioner is provided that can reduce the occurrence of situations in which the comfort level of an occupant of a room is degraded. The air conditioner is capable of running in cooling mode and/or dehumidifying mode and is provided with an air delivery unit, a flap, and a control unit. The air delivery unit delivers conditioned air into the room. The flap determines the discharge direction of the air delivered from the air delivery unit. The control unit executes a first control that changes the swing speed of the flap in accordance with the room temperature.

10 Claims, 9 Drawing Sheets

AIR CONDITIONER AND METHOD OF CONTROLLING AIR CONDITIONER

TECHNICAL FIELD

The present invention relates to an air conditioner and a control method for controlling an air conditioner. More particularly, the present invention relates to an air conditioner capable of running in cooling mode and/or dehumidifying mode and a control method for controlling the same air conditioner.

BACKGROUND ART

Air conditioners that are installed in homes and office buildings and serve to improve the comfort level in a room by delivering conditioned air into the room are a known conventional technology. These air conditioners maintain a room temperature that is comfortable for the occupants by delivering cool air or warm air into the room, thus improving the comfort level of the room.

These air conditioners are provided with a flap for determining the discharge direction of the air that is delivered after being conditioned. The flap is often swung at a constant speed in order to deliver the conditioned air to all corners of the room. Since the flap swing speed of these air conditioners is constant, the amount of time that the delivered air flow contacts the room occupants during each swing is always the same. When the room temperature is comparatively high, it is possible for an occupant to feel that the room is hot because the same amount of air constantly contacts the occupant. When the room temperature is comparatively low, it is possible for an occupant to feel that the room is cold because the same amount of air constantly contacts the occupant. Thus, with conventional air conditioners, there are times when the occupants of the room feel uncomfortable during cooling mode and dehumidifying mode.

SUMMARY OF THE INVENTION

The object of this invention is to provide an air conditioner that can reduce the occurrence of situations in which the comfort level of the room occupants is degraded.

According to a first aspect of the present invention, an air conditioner that is capable of running in cooling mode and/or dehumidifying mode is provided with an air delivery unit, a flap, and a control unit. The flap determines the discharge direction of the air delivered from the air delivery unit. The control unit executes a first control to change the swing speed of the flap in accordance with the room temperature.

With this air conditioner, the air inside the room is conditioned inside the air conditioner. The direction in which the air is discharged is determined by the flap. The swing speed of the flap is changed by the control unit according to the room temperature.

Since the swing speed of the flap is changed according to the room temperature, i.e., since the amount of time the delivered air contacts an occupant during each swing (complete swing including return swing) is changed according to the room temperature, the occurrence of situations in which the comfort level of the room occupants is degraded can be reduced by appropriately setting the room temperatures at which the swing speed is changed and the speed values to which the swing speed is changed.

According to a second aspect of the present invention, the air conditioner of the first aspect of the present invention is provided, wherein the control unit changes the swing speed to a first swing speed when the room temperature is equal to or above a prescribed temperature. When the room temperature below the prescribed temperature, the control unit changes the swing speed to a second swing speed. The first swing speed is slower than the second swing speed.

Thus, when the room temperature is equal to or above the prescribed temperature, the flap is swung at a slower speed than when the room temperature is below the prescribed temperature. Likewise, the amount of time the delivered air contacts the body of an occupant during one swing of the flap is longer when the room temperature is equal to or above the prescribed temperature than when the room temperature is below the prescribed temperature. When the room temperature is equal to or above the prescribed temperature, the sensible temperature experienced by the room occupants decreases because the air delivered from the air conditioner contacts the room occupants for a long period of time. As a result, the occurrence of situations in which the comfort level of the room occupants is degraded is reduced. When the room temperature is below the prescribed temperature, the sensible temperature experienced by the room occupants does not decrease too much because the air delivered from the air conditioner contacts the occupants for only a short period of time. As a result, the occurrence of situations in which the room occupants feel cold is reduced and the occurrence of situations in which the comfort level of the room occupants is degraded is reduced even further.

According to a third aspect of the present invention, the air conditioner of the second aspect of the present invention is provided, wherein the control unit can also execute a second control. The second control does not swing the flap. The air conditioner described in claim 3 is also provided with a selecting means. The selecting means selects between the first control and the second control.

Since either the first control or the second control is selected, this air conditioner can fix the air discharge direction by selecting the second control so that the flap does not swing.

According to a fourth aspect of the present invention, the air conditioner of the third aspect of the present invention is provided, wherein the control unit can also execute a third control. The third control swings the flap at a constant speed at all times. The selecting means selects among the first control, the second control, and the third control.

Since either the first control, the second control, or the third control is selected, this air conditioner can change the air discharge direction at a constant speed by selecting the third control, which swings the flap at a constant speed at all times.

According to a fifth aspect of the present invention, the air conditioner of any one of the first to fourth aspects of the present invention is provided, wherein the control unit swings the flap in an up-and-down direction.

Since the flap is swung up and down, the delivered air can be made to contact the room occupants even when, for example, the air delivery unit is installed above the occupants' heads (ceiling, upper part of wall, etc.) by aiming the flap downward. In short, it is easy to make the delivered air contact the room occupants.

According to a sixth aspect of the present invention, an air conditioner is provided with an air delivery unit for delivering conditioned air into a room and a flap for determining the discharge direction of the air delivered from the air delivery unit and is capable of running in cooling mode and/or dehumidifying mode. The air conditioner control method includes a first step and a second step. In the first step, the room temperature is measured. In the second step, the swing speed of the flap is changed according to the room temperature.

Since the swing speed of the flap is changed according to the room temperature, i.e., since the amount of time the delivered air contacts an occupant during each swing (complete swing including return swing) is changed according to the room temperature, the occurrence of situations in which the comfort level of the room occupants is degraded is reduced.

BRIEF DESCRIPTIONS OF THE DRAWINGS

PREFERRED EMBODIMENTS OF THE INVENTION

Constituent Features of the Air Conditioner>

Figure 1:
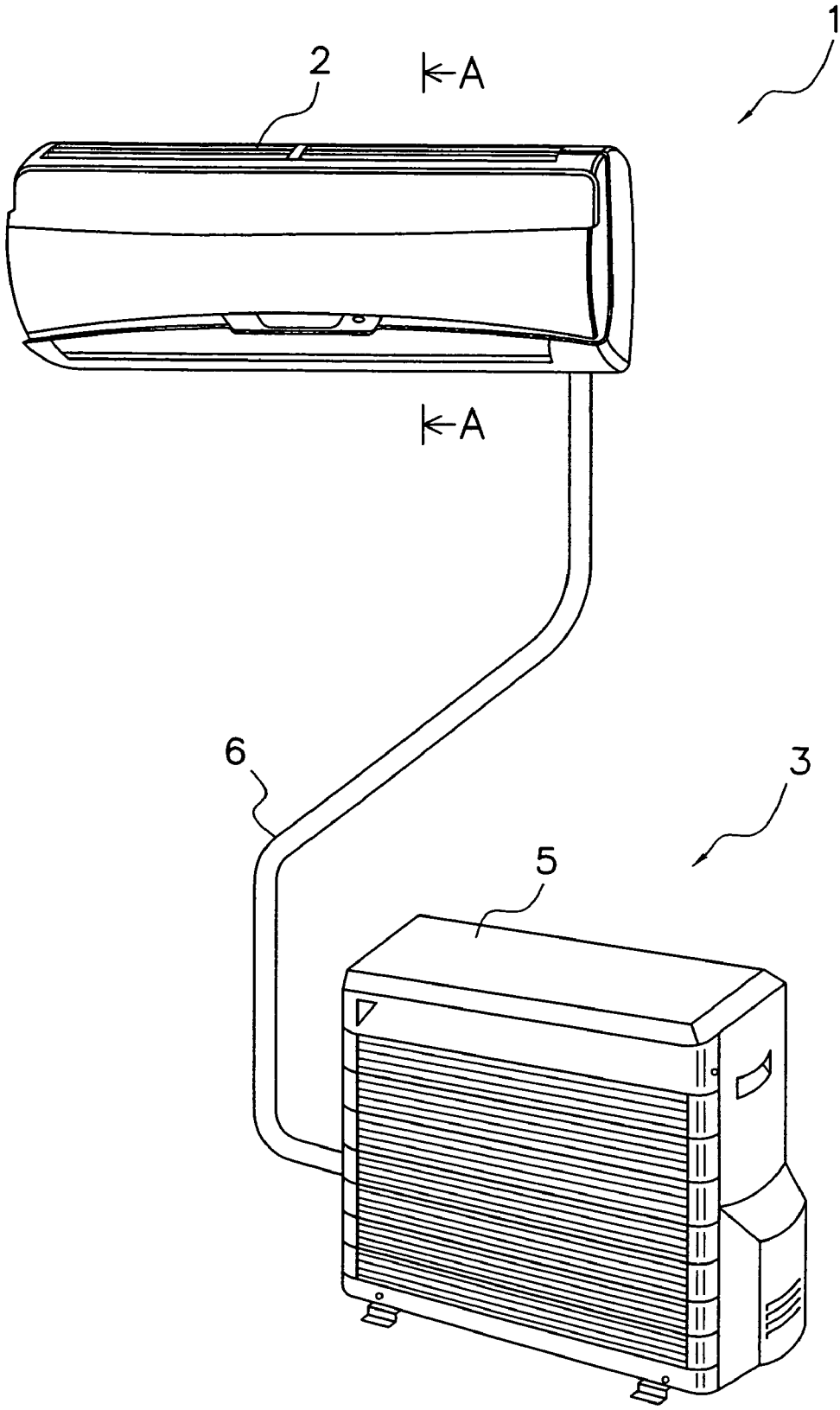
FIG. 1 shows the external appearance of an air conditioner in which an embodiment of the present invention has been employed.

FIG. 1 shows the external appearance of an air conditioner 1 in which an embodiment of the present invention has been employed.

The air conditioner 1 is a device that delivers conditioned (i.e., cooled, heated, dehumidified, etc.) air into a room to condition the air inside the room. The air conditioner 1 is provided with an indoor unit 2 installed on an upper section of a wall inside the room and an outdoor unit 3 installed outdoors. The outdoor unit 3 is provided with an outdoor air conditioning unit 5 that encloses an outdoor heat exchanger and an outdoor fan.

The indoor unit 2 encloses an indoor heat exchanger and the outdoor air conditioning unit 5 encloses an outdoor heat exchanger. These heat exchangers together with the refrigerant pipe 6 connecting them constitute a refrigerant circuit.

Figure 2:
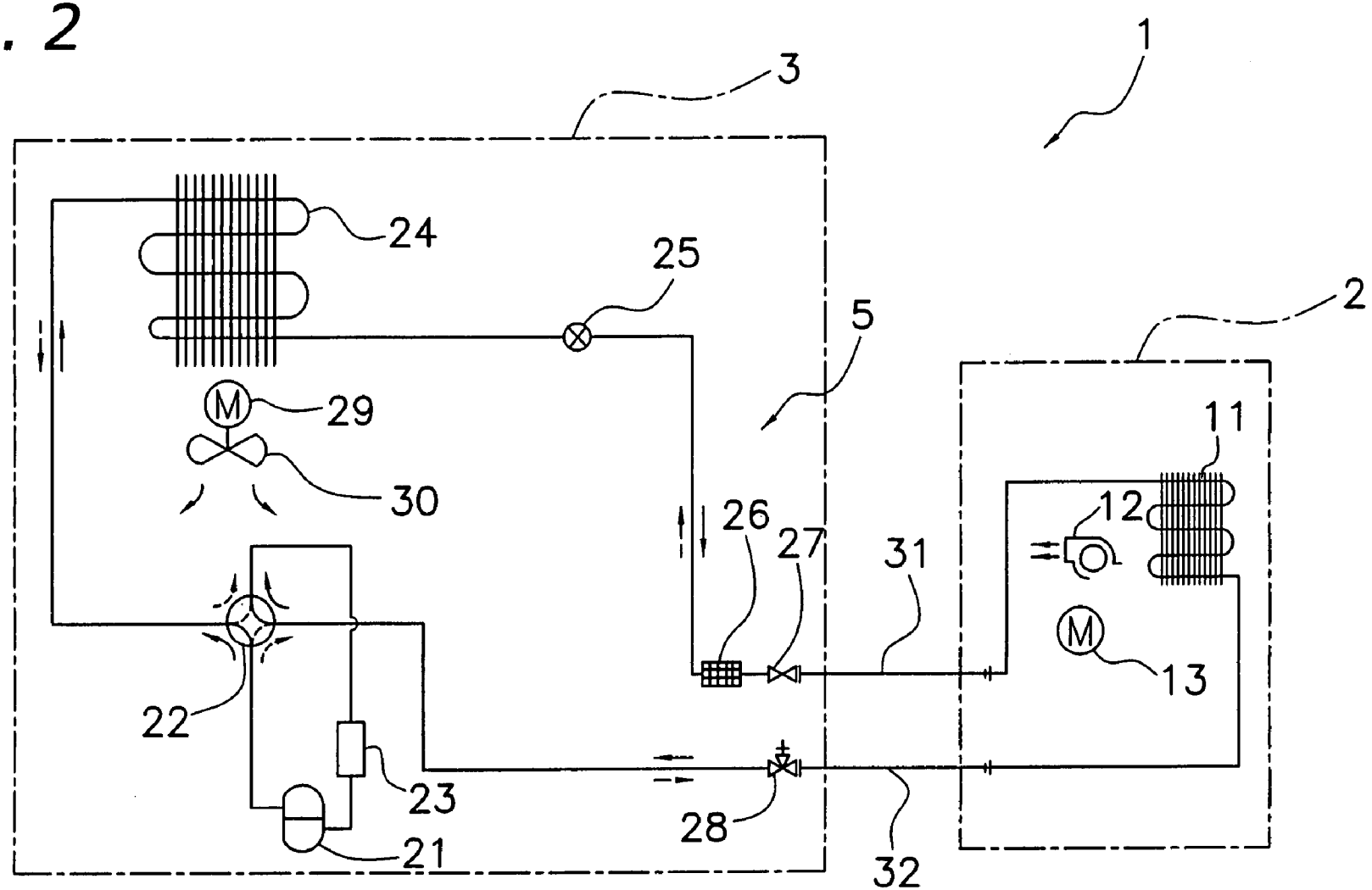
FIG. 2 is a schematic view of the refrigerant circuit.

The refrigerant circuit used in the air conditioner 1 is illustrated in the flow diagram of FIG. 2.

The indoor heat exchanger 11 is provided inside the indoor unit 2. The indoor heat exchanger 11 includes a heat exchanger tube that is folded back a plurality of times in the lengthwise direction and a plurality of fins through which the heat exchanger tube is passed. The indoor heat exchanger 11 exchanges heat with the air it contacts.

A cross flow fan 12 is also provided inside the indoor unit 2 and serves to blow the air that has exchanged heat with the indoor heat exchanger 11 into the room. The cross flow fan 12 is cylindrical in shape and is provided with blades arranged on its circumferential surface so as to be parallel to the rotational axis thereof. The cross flow fan 12 generates an air flow in a direction that intersects with the rotational axis. The cross flow fan 12 is rotationally driven by a fan motor 13 provided inside the indoor unit 2.

The outdoor air conditioning unit 5 is provided with a compressor 21, a four-way selector valve 22, an accumulator 23, an outdoor heat exchanger 24, and a pressure reducer 25 (see FIG. 2). The four-way selector valve 22 is connected to the discharge side of the compressor 21. The accumulator 23 is connected to the intake side of the compressor 21. The outdoor heat exchanger 24 is connected to the four-way selector valve 22. The pressure reducer 25 is an electric powered expansion valve connected to the outdoor heat exchanger 24. The pressure reducer 25 is connected to a pipe 31 through a filter 26 and a liquid shut-off valve 27 and, thus, is connected to one end of the indoor heat exchanger 11 through the pipe 31. The four-way selector valve 22 is connected to a pipe 32 through a gas shut-off valve 28 and, thus, is connected to the other end of the indoor heat exchanger 11 through the pipe 32. These pipes 31, 32 are equivalent to the refrigerant pipe 6 shown in FIG. 1.

Figure 3:
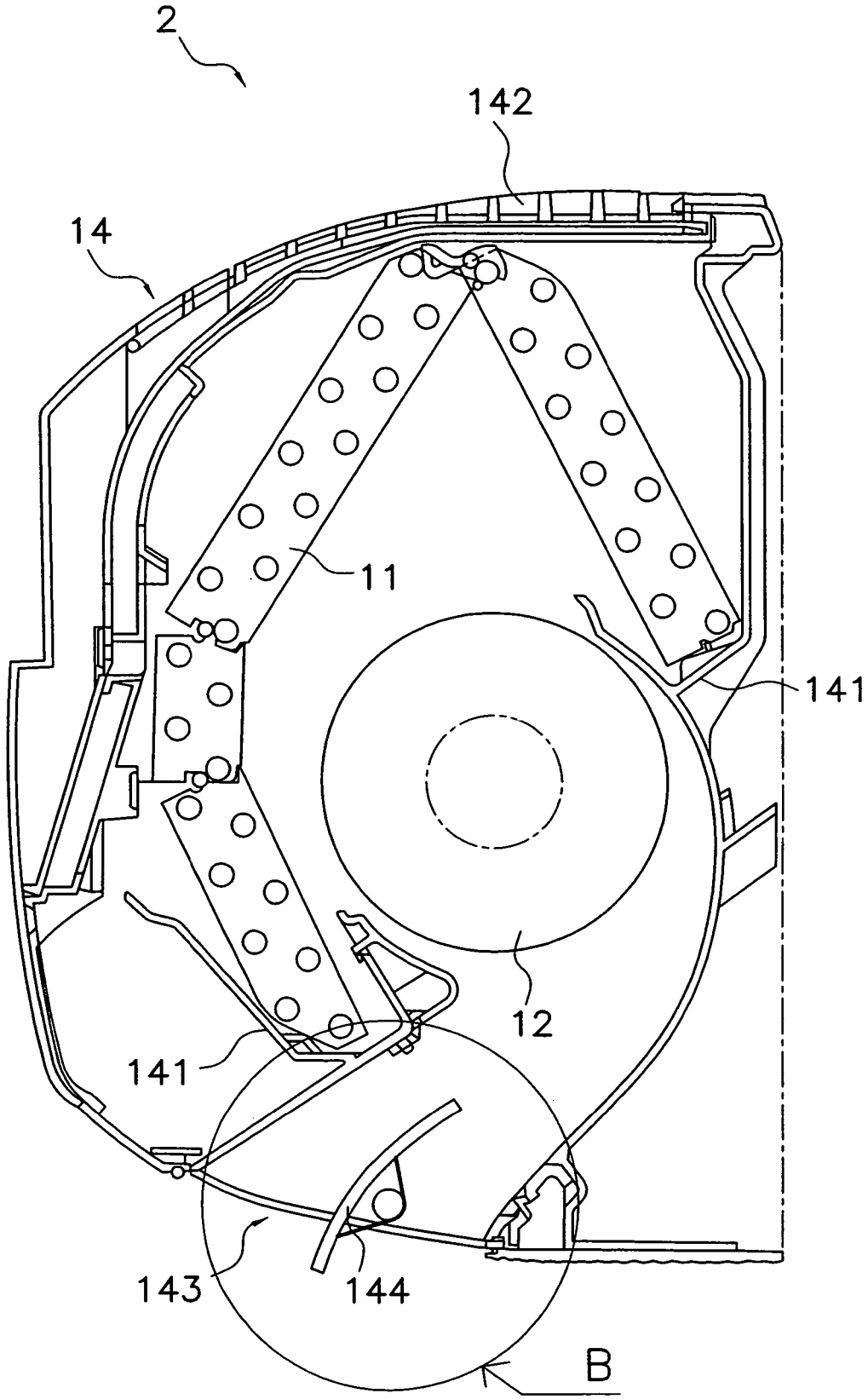
FIG. 3 is a cross sectional view of the indoor unit taken along line A—A of FIG. 1.

A cross sectional view of the indoor unit 2 is shown in FIG. 3. The previously described indoor heat exchanger 11 and the cross flow fan 12 are housed inside the casing 14 of the indoor unit 2. The indoor heat exchanger 11 is arranged so as to surround the front, top, and upper rear portions of the cross flow fan 12. The cross flow fan 12 draws air into the unit through intake openings 142. As the air moves toward the cross flow fan 12, it exchanges heat with the refrigerant inside the heat exchanger tube of the indoor heat exchanger 11.

A drain pan 141 is provided below the indoor heat exchanger 11 to catch water droplets that form on the surface of the indoor heat exchanger 11 during the process of exchanging heat. The drain pan 141 has a drain hose (not shown) for discharging the water droplets caught to the outside. The drain pan 141 is constructed such that it catches water droplets and discharges the water droplets by means of the drain hose.

Figure 4:
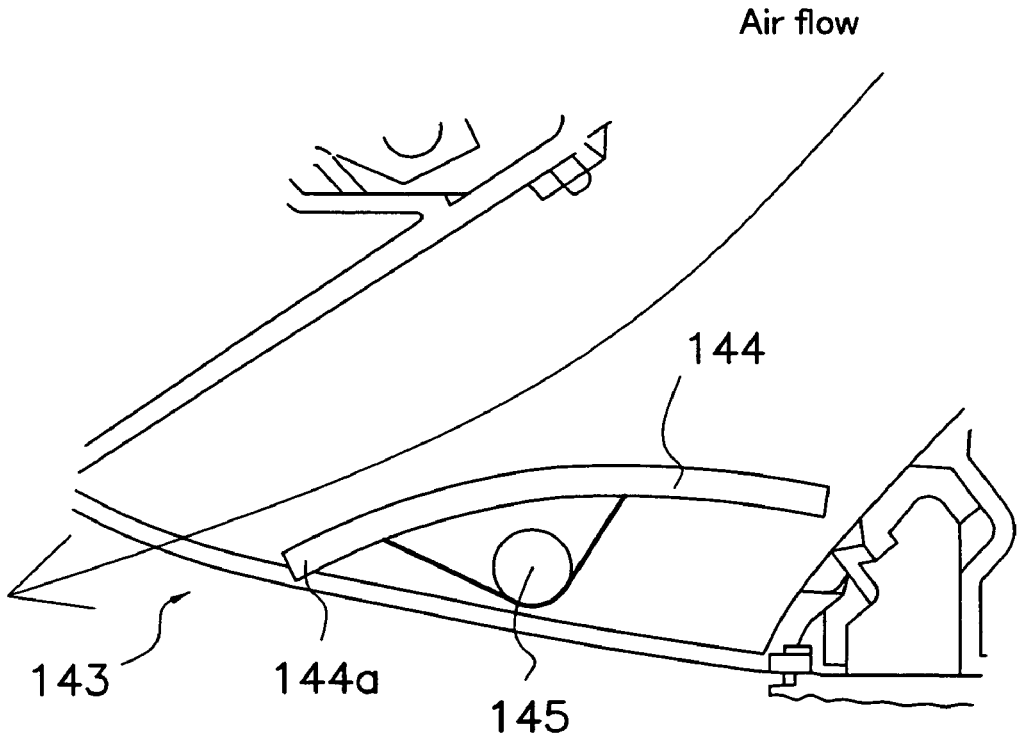
FIG. 4 is an enlarged view of section B of FIG. 3 when the flap is horizontal.
Figure 5:
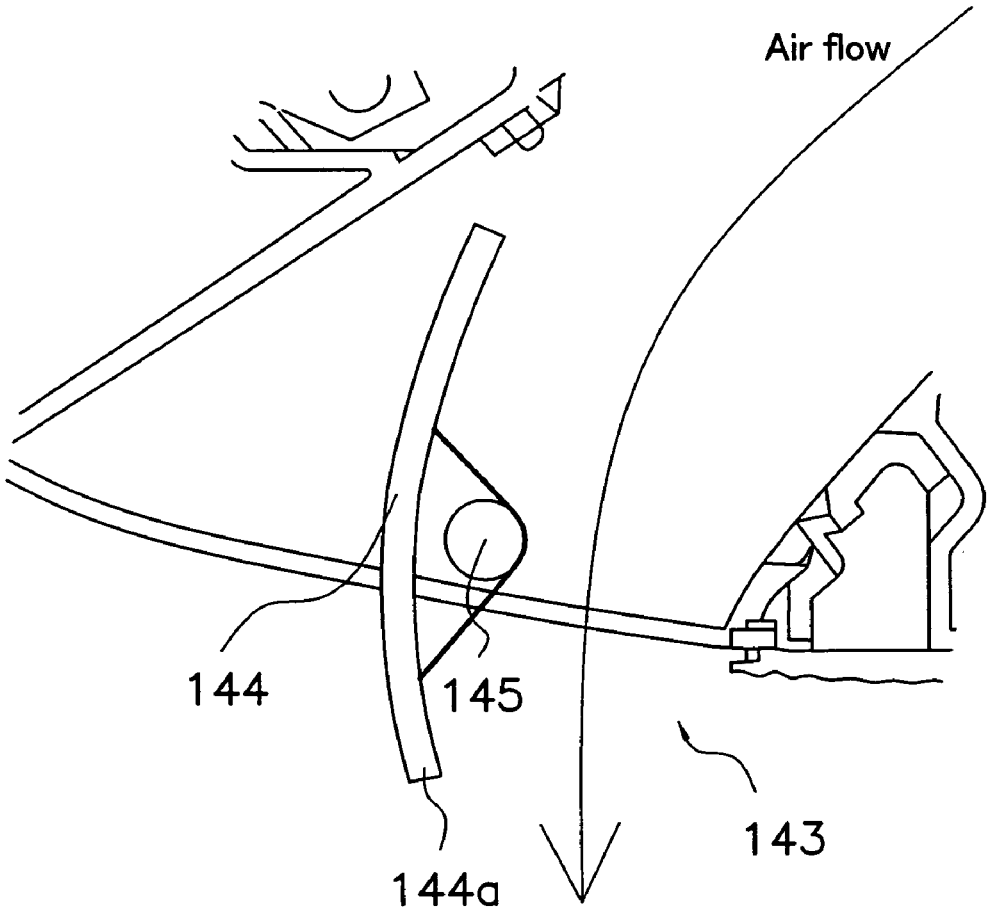
FIG. 5 is an enlarged view of section B of FIG. 3 when the flap is directed downward.
Figure 6:
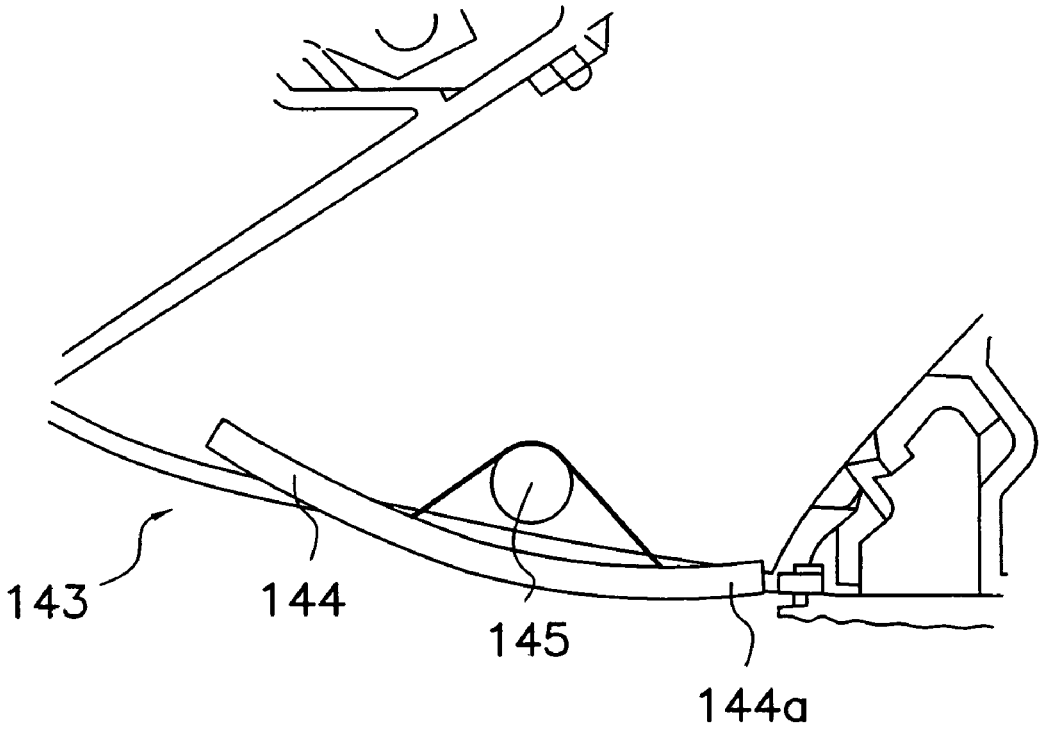
FIG. 6 is an enlarged view of section B of FIG. 3 when the air conditioner is not running.

An intake opening 142 made up of a plurality of slit-shaped openings is provided in an upper part of the casing 14. An outlet opening 143 that is long in the lengthwise direction of the indoor unit 2 is provided in a lower part of the casing 14. A horizontal flap 144 for determining the discharge direction of the air delivered into the room by the cross flow fan 12 is provided in the outlet opening 143. The horizontal flap 144 can rotate freely about a shaft 145 that is parallel to the lengthwise direction of the indoor unit 2. The horizontal flap 144 can determine the discharge direction of the air by being rotated by a flap motor 146 (see FIG. 7), which is described later. As shown in FIG. 4, the conditioned air is blown in an approximately horizontal direction when the edge part 144*a* of the horizontal flap 144 points in an approximately horizontal direction. As shown in FIG. 5, the conditioned air is blown in an approximately vertical downward direction when the edge part 144*a* of the horizontal flap 144 points in an approximately vertical downward direction. As shown in FIG. 6, the edge part 144*a* of the horizontal flap 144 touches an edge part of the casing 14 when the air conditioner 1 is not running. In this state, the horizontal flap 144 covers the outlet opening 143 almost completely.

Inside the outdoor air conditioning unit 5 is provided a propeller fan 29 for discharging air to the outside after the air has exchanged heat with the outdoor heat exchanger 24. The propeller fan 29 is rotationally driven by a propeller fan motor 30.

<Control Unit>

Figure 7:
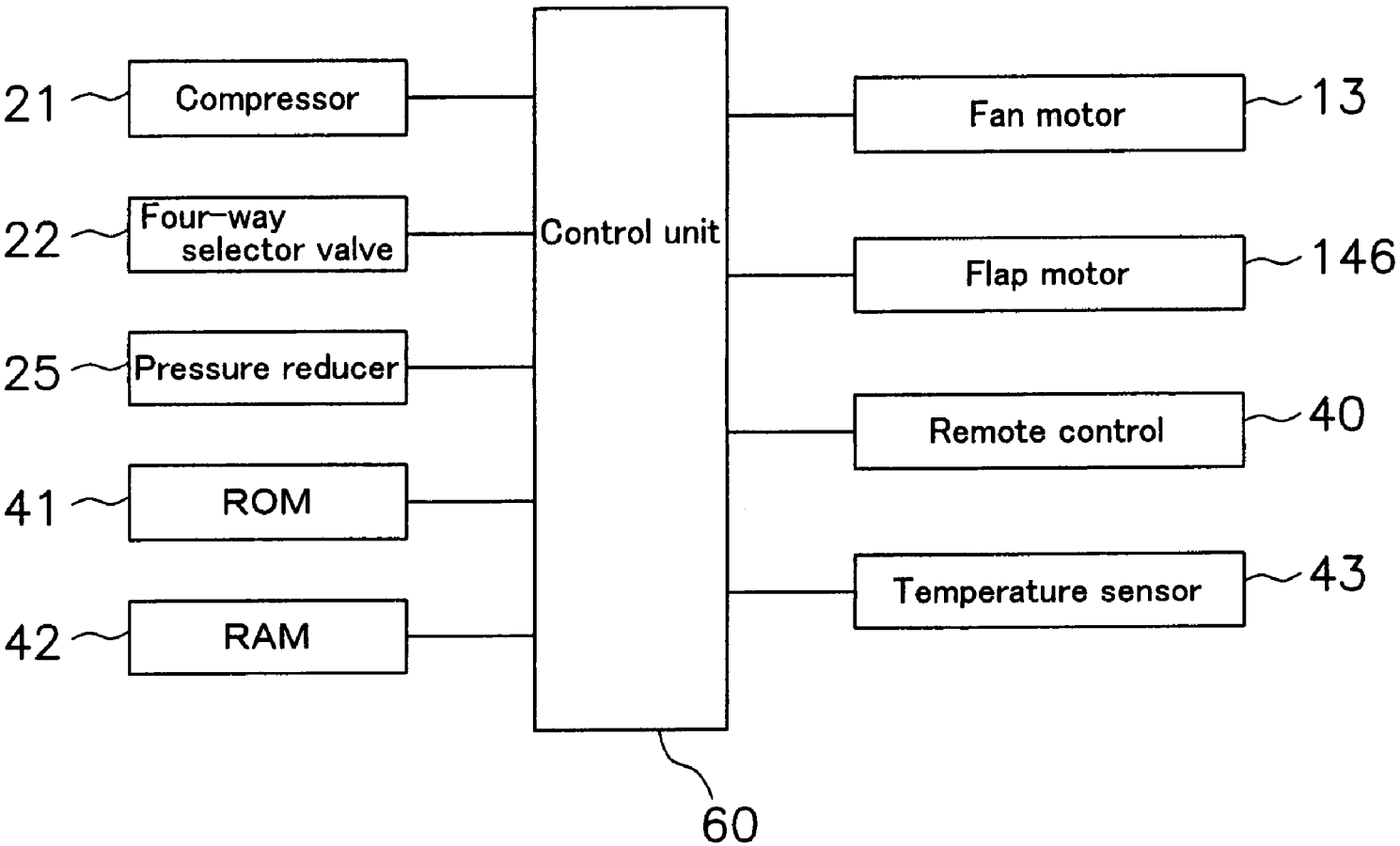
FIG. 7 is a block diagram of the control unit.

The air conditioner 1 is also provided with a control unit 60. As shown in FIG. 7, the control unit 60 is connected to the compressor 21, the four-way selector valve 22, the pressure reducer 25, a ROM 41, a RAM 42, the fan motor 13, the flap motor 146, a remote control 40, and a temperature sensor 43. The control unit 60 executes control of the pressure reducer 21, the four-way selector valve 22, the pressure reducer 25, the fan motor 13, the flap motor 146, etc.

Figure 8:
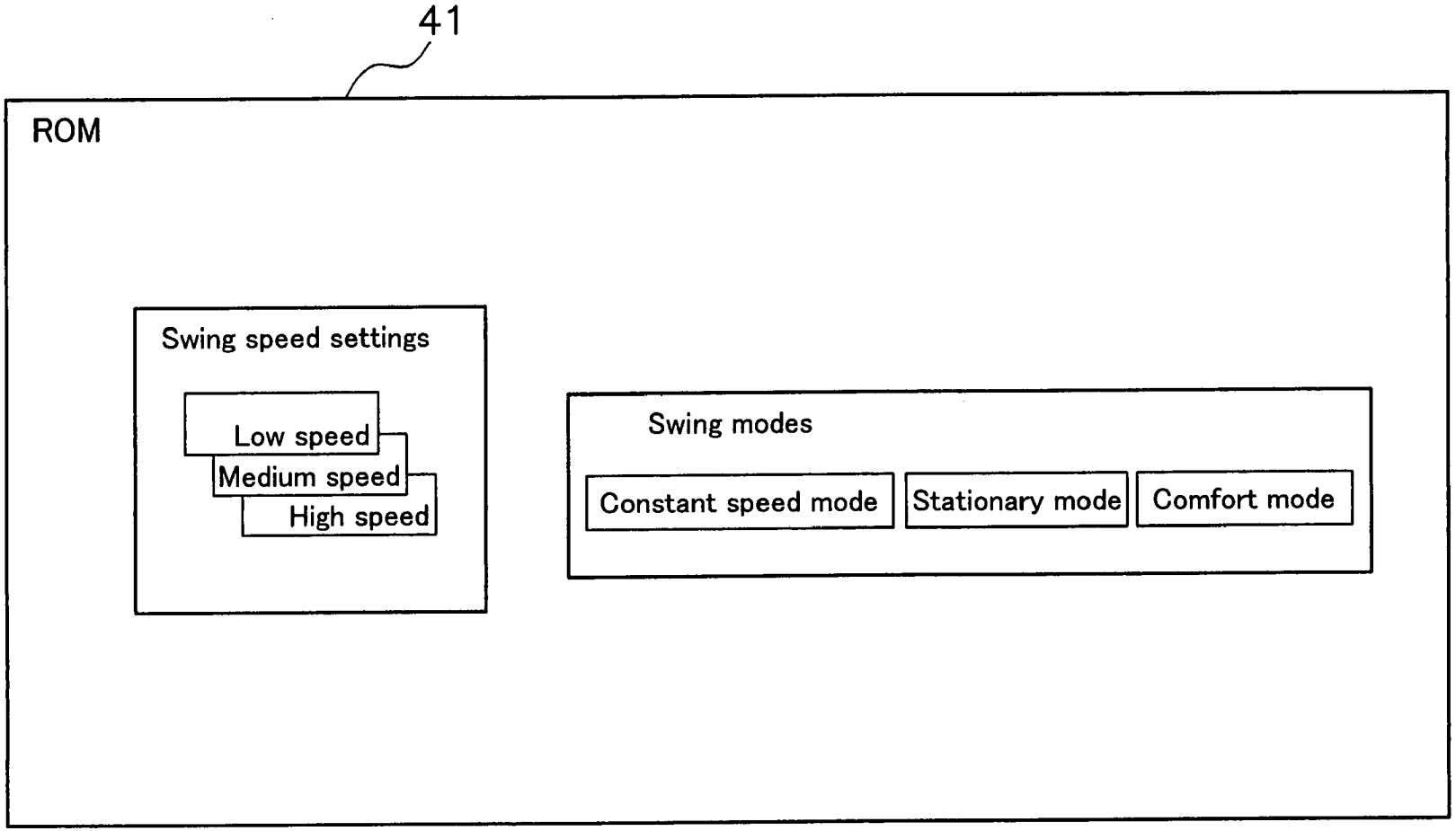
FIG. 8 is a block diagram of the ROM.

The ROM 41 stores control programs and various parameters. The ROM 41 also stores the swing speed settings and swing modes of the horizontal flap 144 (see FIG. 8).

The swing speed settings are operating speeds for determining the swing speed of the horizontal flap 144. More specifically, the swing speed setting is selected from among a "high speed," a "medium speed," and a "high speed." The "low speed" is the slowest swing speed and the "high speed" is the fastest swing speed. The control unit 60 rotates the flap motor 146 in such a manner as to swing the horizontal flap 144 at a speed corresponding to the selected swing speed setting.

The swing modes are for determining whether or not the horizontal flap 144 will be swung or how it will be swung. There are three swing modes: constant speed mode, stationary mode, and comfort mode. In constant speed mode, the horizontal flap 144 is swung intermittently at a constant speed. In stationary mode, the horizontal flap 144 is stopped at a certain point (angle) during mid-swing and held stationary at that angle. In comfort mode, the swing speed of the horizontal flap 144 is changed in accordance with the room temperature (details discussed later). As will be described later, a room occupant transmits the desired mode to the control unit 60 with the remote control 40. The control unit 60 controls the swinging of the horizontal flap 144 using the transmitted mode.

The remote control 40 is a user-operated device that transmits the room occupant's instructions to the air conditioner 1 so that the air conditioner 1 can be operated according to the wishes of the room occupant. The room occupant can use the remote control 40 to set the target temperature and to select the swing speed and swing mode of the horizontal flap 144. These instructions are transmitted from the remote control 40 to the control unit 60 and used for control of the various components. These instructions are also sent from the remote control 60 to the RAM 42 and stored in the RAM 42.

The temperature sensor 43 is provided in the indoor unit 2 and serves to measure the temperature inside the room. The temperature sensor 43 transmits the measured temperature to the control unit 60.

<Operation of the Air Conditioner 1>

Figure 9:
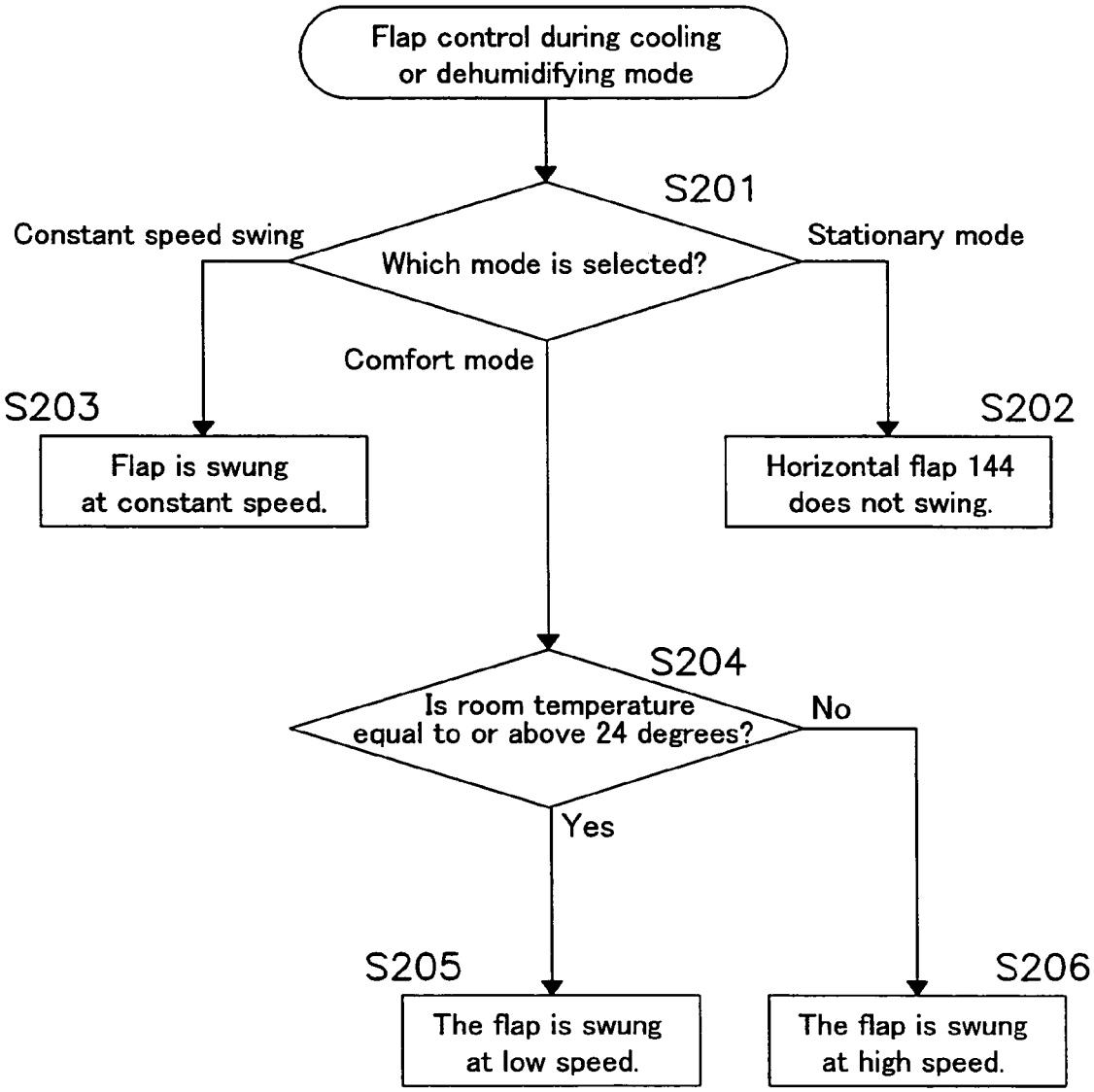
FIG. 9 is swing control flowchart for a horizontal flap during cooling mode and dehumidifying mode.

The swing control of the horizontal flap 144 during cooling mode and dehumidifying mode will not be described (see FIG. 9). First, the control unit 60 checks which swing mode has been selected (step S201). If the stationary mode has been selected, the control unit 60 does not swing the horizontal flap 144 (step S202). If the constant speed mode has been selected, the control unit 60 sets the swing speed of the horizontal flap 144 to the "medium speed" (step S203). If the comfort mode has been selected, the control unit 60 determines if the room temperature is equal to or above 24 Celsius (step S204). If the room temperature is below 24 Celsius, the control unit 60 sets the swing speed of the horizontal flap 144 to the "low speed" (step S205). If the room temperature is equal to or above 24 Celsius, the control unit 60 sets the swing speed of the horizontal flap 144 to the "high speed" (step S206).

<Characteristic Features of the Air Conditioner>

(1)

With this air conditioner 1, the horizontal flap 144 is swung at "low speed" when the room temperature is equal to or above 24 Celsius. Consequently, the sensible temperature experienced by the room occupants decreases because the air delivered from the air conditioner 1 contacts the room occupants for a long period of time during each swing. As a result, the occurrence of situations in which the comfort level of the room occupants is degraded is reduced. Meanwhile, the horizontal flap 144 is swung at "high speed" when the room temperature is below 24 Celsius. Consequently, the sensible temperature experienced by the room occupants doesn't decrease too much because the air delivered from the air conditioner 1 contacts the room occupants for only a short period of time. As a result, the occurrence of situations in which the room occupants feel cold is reduced and the occurrence of situations in which the comfort level of the room occupants is degraded is reduced even further.

Thus, when the room temperature is 24 Celsius or above, the occupants can experience a feeling of comfort similar to that experienced with a conventional air conditioner even if the temperature setting of the air conditioner 1 is set somewhat higher. As a result, the electric power consumption per unit time can be reduced.

(2)

With the air conditioner 1, a stationary mode in which the horizontal flap 144 does not swing can also be selected. Thus, the direction in which the conditioned air is blown can be fixed.

(3)

With the air conditioner 1, a low speed mode in which the horizontal flap 144 is swung at a "medium speed" can also be selected. Thus, the direction in which the conditioned air is blown can be changed at a constant speed.

(4)

With this air conditioner 1, the horizontal flap 144 is swung up and down. Thus, when the horizontal flap 144 is swung upward, it is difficult for the delivered air to contact the room occupants. Meanwhile, when the horizontal flap 144 is swung downward, it is easy for the delivered air to contact the room occupants. As a result, the delivered air can easily be made to contact the room occupants even when the indoor unit 2 is installed above the room occupants' heads (on the ceiling, an upper part of a wall, or the like).

(5)

With this air conditioner 1, the horizontal flap 144 is swung at "low speed" when the room temperature is below 24 Celsius. Thus, the air delivered from the air conditioner 1 can sufficiently disperse the cool air existing around the room occupants' feet. As a result, overcooling of the room occupants' feet can be suppressed.

OTHER EMBODIMENTS (A)

In the previously described embodiment, the control unit 60 sets the swing speed of the horizontal flap 144 to the "low speed" when the temperature inside the room is equal to or above 24 Celsius. Meanwhile, when the temperature inside the room is below 24 Celsius, the control unit 60 sets the swing speed of the horizontal flap 144 to the "high speed." Instead, it is also acceptable for the control unit 60 to set the swing speed of the horizontal flap 144 to the "low speed"

when the temperature inside the room is equal to or above 25 Celsius and to the "high speed" when the temperature inside the room is below 23 Celsius. In other words, it is acceptable to make the threshold temperature a range instead of a single temperature.

(B)

In the previously described embodiment, the control unit 60 sets the swing speed of the horizontal flap 144 to the "low speed" when the temperature inside the room is equal to or above 24 Celsius. Meanwhile, when the temperature inside the room is below 24 Celsius, the control unit 60 sets the swing speed of the horizontal flap 144 to the "high speed." Instead, it is also acceptable to design the system such that a room occupant can set the threshold temperature used to control the swing speed of the horizontal flap 144.

APPLICABILITY TO INDUSTRY

When an air conditioner in accordance with the present invention is used, the swing speed of the flap is changed according to the room temperature and the amount of time the delivered air contacts the room occupants during each swing (complete swing including return swing) is changed according to the room temperature. Therefore, the occurrence of situations in which the comfort level of the room occupants is degraded can be reduced by appropriately setting the room temperatures at which the swing speed is changed and the speed values to which the swing speed is changed.

The invention claimed is:

1. An air conditioner comprising:

an air delivery unit configured to deliver conditioned air into a room;

a flap configured to adjust a discharge direction of the conditioned air delivered from the air delivery unit; and a control unit configured to execute a first control to change a swing speed of the flap without changing a swing range of the flap in accordance with a detected room temperature.

2. The air conditioner as recited in claim 1, wherein the control unit is further configured to execute the first control without detecting solar radiation, the first control including changing the swing speed to a first swing speed when the detected room temperature is equal to or above a prescribed room temperature and changing the swing speed to a second swing speed that is faster than the first swing speed when the detected room temperature is below the prescribed temperature.

3. The air conditioner as recited in claim 2, further comprising a selecting device configured to select either the first control or a second control that does not change the swing speed of the flap, and the control unit being further configured to selectively execute the second control that does not change the swing speed of the flap upon selection of the second control by the selecting device.

4. The air conditioner as recited in claim 3, wherein the selecting device is configured to select one of the first control, the second control or a third control that swings the flap at a constant speed at all times, and the control unit is further configured to selectively execute the third control that swings the flap at a constant speed at all times.

5. The air conditioner as recited in claim 4, wherein the flap is horizontally arranged and the control unit is further configured to swing the flap in an up and down direction.

6. The air conditioner as recited in claim 3, wherein the flap is horizontally arranged and the control unit is further configured to swing the flap in an up and down direction.

7. The air conditioner as recited in claim 2, wherein the flap is horizontally arranged and the control unit is further configured to swing the flap in an up and down direction.

8. The air conditioner as recited in claim 1, wherein the air conditioner is for a home or office building.

9. An air conditioner comprising:

means for measuring room temperature of a room with the air conditioner installed therein;

conditioned air delivering means for delivering conditioned air into the room;

directional means for adjusting a discharge direction of the conditioned air delivered from the conditioned air delivering means; and means for changing a speed of the directional means without changing a swing range of the directional means in accordance with the room temperature that was measured.

10. A method of controlling an air conditioner comprising:

measuring room temperature of a room with the air conditioner installed therein;

delivering conditioned air into the room from an air delivery unit;

controlling a flap downstream of the air delivery unit for adjusting a discharge direction of the conditioned air delivered from the air delivery unit; and changing a swing speed of the flap in accordance with the room temperature that was measured without changing a swing range of the flap.

* * * * *